US008013227B2

(12) United States Patent
Trinca

(10) Patent No.: US 8,013,227 B2
(45) Date of Patent: Sep. 6, 2011

(54) TOY PIANO

(76) Inventor: Leonard Trinca, St. Augustine, FL (US)

( * ) Notice: Subject to any disclaimer, the term of this patent is extended or adjusted under 35 U.S.C. 154(b) by 0 days.

(21) Appl. No.: 12/655,610

(22) Filed: Jan. 4, 2010

(65) Prior Publication Data

US 2010/0255754 A1 Oct. 7, 2010

Related U.S. Application Data

(63) Continuation-in-part of application No. 12/419,707, filed on Apr. 7, 2009, now Pat. No. 7,671,259.

(51) Int. Cl.
*G10F 1/02* (2006.01)

(52) U.S. Cl. ..... 84/13; 446/143; 446/318

(58) Field of Classification Search ..... 84/13, 26, 84/79, 423; 446/143, 213, 318, 418, 491
See application file for complete search history.

(56) References Cited

U.S. PATENT DOCUMENTS 5,773,738 A * 6/1998 Chou ..... 84/600

* cited by examiner

*Primary Examiner* — Kimberly R Lockett

(74) *Attorney, Agent, or Firm* — Steven R. Scott

(57) ABSTRACT

In order to be able to salvage toy pianos that have become damaged during shipping, a structure and process for manufacture of toy pianos has been developed wherein (1) stop piece (or block members) are permanently affixed to certain side forming members, allowing certain other side forming members to be non-permanently affixed thereto via connectors non-permanently anchored to said block members; (2) horizontal slits are provided near the bottom of certain side members to fit over edges of the bottom member, allowing the edges of said bottom member to firmly but non-permanently nest therein; and (3) vertical grooves are provided near ends of certain side members to fit over ends of certain other side members, allowing the ends of said certain other side members to firmly but non-permanently nest therein. These innovations each assist, and together greatly facilitate, the production of a toy piano that is solid and durable in structure while simultaneously allowing easy replacement of damaged parts. Rather than the entire piano needing to be discarded the damage part can simply be removed and a new piece put in its place.

18 Claims, 5 Drawing Sheets

TOY PIANO

PRIORITY CLAIM TO PARENT APPLICATION

This application is a continuation-in-part of parent application Ser. No. 12/419,707 titled "Process for the Manufacture of a Toy Piano" filed Apr. 7, 2009 now U.S. Pat. No. 7,671,259, the same being incorporated herein by reference and claims priority thereto.

BACKGROUND AND SUMMARY

My invention pertains to the manufacture of baby grand and upright toy pianos. Toy pianos are generally smaller than a typical piano and usually have around eighteen to forty-nine keys although there are some variations. One of the difficulties in the toy piano industry is that many of the pianos are damaged during the shipping process. Currently the sides of the toy piano are glued and it is impossible to remove the damaged part without damaging the other exterior parts of the piano. Because of the current manufacturing process, the piano must be discarded.

My invention is a toy piano and manufacturing process therefor by which replacement parts are created and can be easily substituted for the original parts used. In the event that a part of the exterior of the piano is damaged, the replacement part can be used to replace the damaged part. In addition to reducing the costs of replacement of a piano, it also leads to greater customer service satisfaction because the customer is not forced to wait for a replacement piano. There are prior art references to manufacturing processes for toy pianos and toy pianos, but none that involve a manufacturing process for a toy piano and a toy piano as specified herein.

The essential parts of a piano are the same in both the baby grand and the upright version of the toy piano. Baby grand and upright toy pianos rest on the floor typically with a set of legs. The exact style of the support means such as the legs may be different and may vary from company to company and by style of piano, but each piano must be supported by a set of legs or functionally equivalent support members. On the front of the piano will be a set of keys, both white and black, on which the child can play. As stated earlier, a toy piano is typically a piano with fewer keys and the child sits in front of those keys to play the instrument. A front member that forms part of the enclosure that houses the sound board will be placed perpendicular to the keys and will usually be connected to the bottom surface of the piano. The legs themselves will typically be attached to the bottom surface of the piano and will be able to support the weight of the piano. Different style supports of legs may be used but the weight of the piano must be supported.

Overall the piano has a predetermined shape created by joining a plurality of planar side forming members including a bottom member and a plurality of side members, which side members include a back side member, a front side member, and lateral side members. The lateral side members are generally secured to the bottom side of the piano. The two lateral side members, a back side member and a front side member form a box or enclosure around the interior components of the piano. Fixed within the interior of the enclosure that is formed will be the sound board that produces the music when the piano is played. With the baby grand version a plate or protective covering will be placed above the sound board to protect the sound board. Over the top of the protective plate will be the top member which forms the top surface of the piano/enclosure. The top member will mate with the lateral side members, back side member and front side member of the piano to compete the enclosure that houses the sound board. These sides will be constructed from pre-sized pieces to fit a variety of pianos that will be connected by a non-permanent connector of some type. The connector may vary because of piano style but it is anticipated that the connectors will be threaded members.

In order to insure that the parts fit within the frame of a toy piano, provide a means for non-permanently affixing the lateral sides and other parts of the toy piano together, and to assist in stabilizing and strengthening the structure of the toy piano, stop pieces (or "blocks") are provided. These can take the form of horizontal or vertical pieces that extend along the length or breadth of a piano side forming member, typically that of lateral side members. However, in some cases they can also take the form of a planar member, such as the planar stop piece used for this purpose in the toy upright. Their stability and durability and, hence, that of the entire toy piano structure are improved by nesting some portion of these blocks in a parallel groove ("dado") provided in the surface of the said side forming member, providing increased surface area for adhesive and generally creating a much stronger and more reliable juncture between parts.

In the preferred embodiment illustrated in FIGS. 1 through 3, the horizontal stop pieces or blocks are separated by a vertical stop piece. The vertical stop piece separates the keys of the piano from the sound board. The use of the horizontal and vertical stop pieces insures that the pieces that are cut are all uniform in length. A hole in the horizontal stop piece is provided for the connector used to secure lateral side members in this embodiment, and is typical of the use of stop members or blocks for this purpose in the invention.

Typically the damage to a toy piano occurs during the shipping process and usually the damage is to the legs or a portion of the exterior that forms the housing to protect the sound board. With this application the damaged part is removed by removing the connectors and the replacement part is inserted in its place. In order to insure that the replacement part is aesthetically pleasing the replacement part may be manufactured with the same color paint as the original piano.

A series of slots and grooves are also provided in the lateral side members and bottom member of the piano. These also act in a manner similar to dados into which transverse abutting members (side or bottom) are fitted, simultaneously providing a strengthened connection between such adjacent and abutting parts (since the use of removable connectors as previously specified eliminates the need to glue such parts together) while allowing damaged part(s) to be easily removed after loosening and removal of such connectors so that a replacement part can be inserted. For instance, if a side member becomes damaged, the side member can be replaced by removing the connector without the need to discard the entire piano.

In summary, the chief problem to be overcome in producing a piano or toy piano with the desirable features described herein is how to create an enclosure where portions (primarily sides) thereof can be easily replaced that is still as solid, durable and functional as an enclosure where abutting edges and ends of the side forming members are permanently affixed to each other by gluing them together or otherwise. I have discovered that this can be accomplished by providing a combination and system whereby (1) stop pieces (or block members) are permanently affixed to certain side forming members, allowing certain other side forming members to be non-permanently affixed thereto via connectors anchored to said block members; (2) horizontal slits are provided near the bottom of certain side members to fit over edges of the bottom member, allowing the edges of said bottom member to firmly but non-permanently nest therein; and (3) vertical grooves are provided near ends of certain side members to fit over ends of certain other side members, allowing the ends of said certain other side members to firmly but non-permanently nest therein.

Further, I have found that best results and appearance are obtained when two vertical grooves are provided in each lateral side member (allowing front and back side pieces to nest therein), and block (stop piece) and non-permanent connector combinations are used to non-permanently attach the lateral side members to the bottom member and/or the top member, holding the front and back side members locked into position in the aforesaid vertical grooves with the previously mentioned horizontal slits further stabilizing the connection and positioning of the lateral side members with respect to the bottom member. Likewise, it is also highly desirable and advantageous in assuring stability and durability of the structure and the permanent connection between the block and the member to which it is affixed to have some portion of the aforesaid block affixed in a parallel groove ("dado") as discussed above. These and other preferred features of my invention will be discussed in more detail below.

DESCRIPTION

Figure 1:
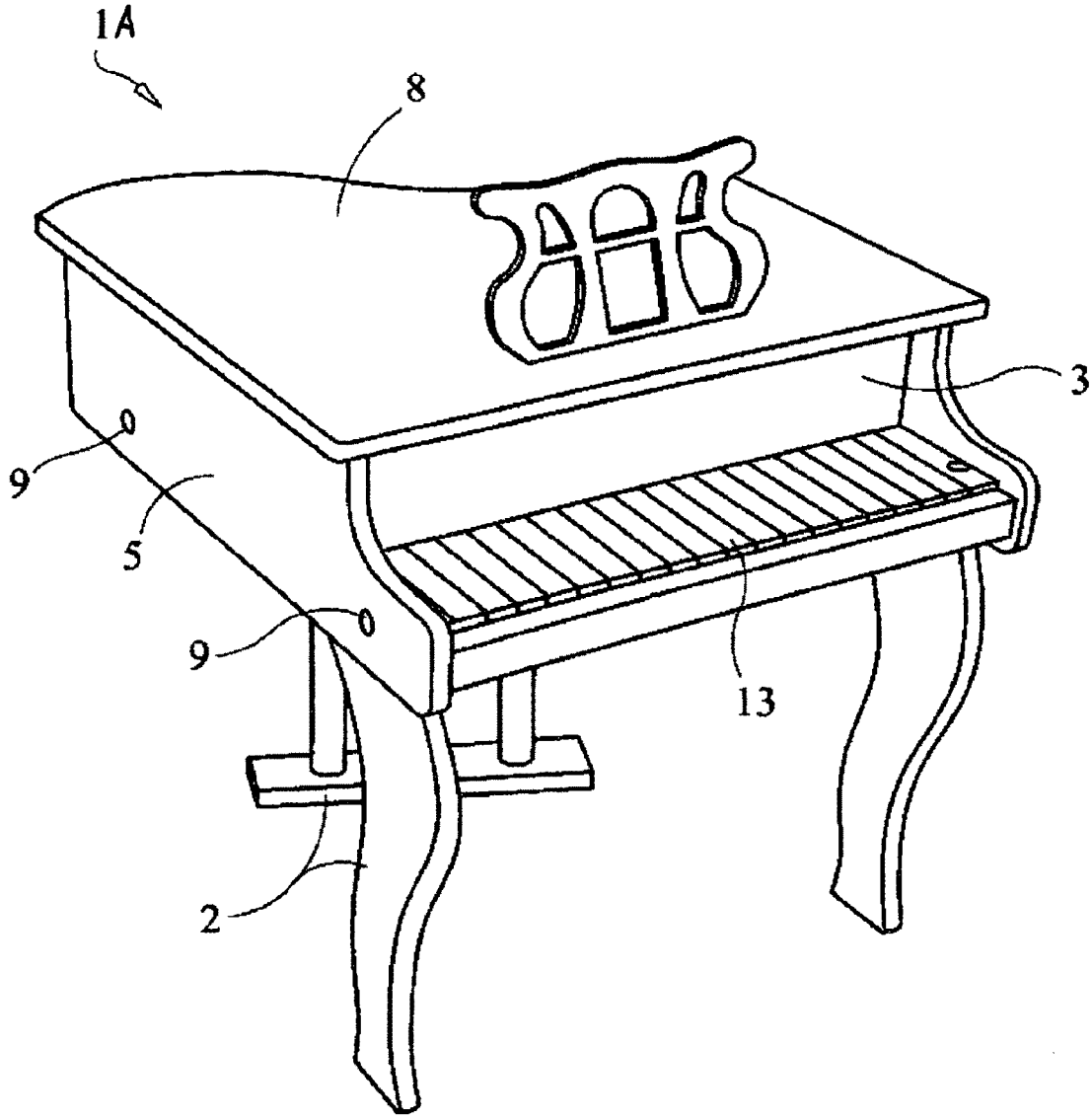
FIG. 1 provides a perspective view of a baby grand toy piano in accordance with the teachings of my invention.
Figure 2:
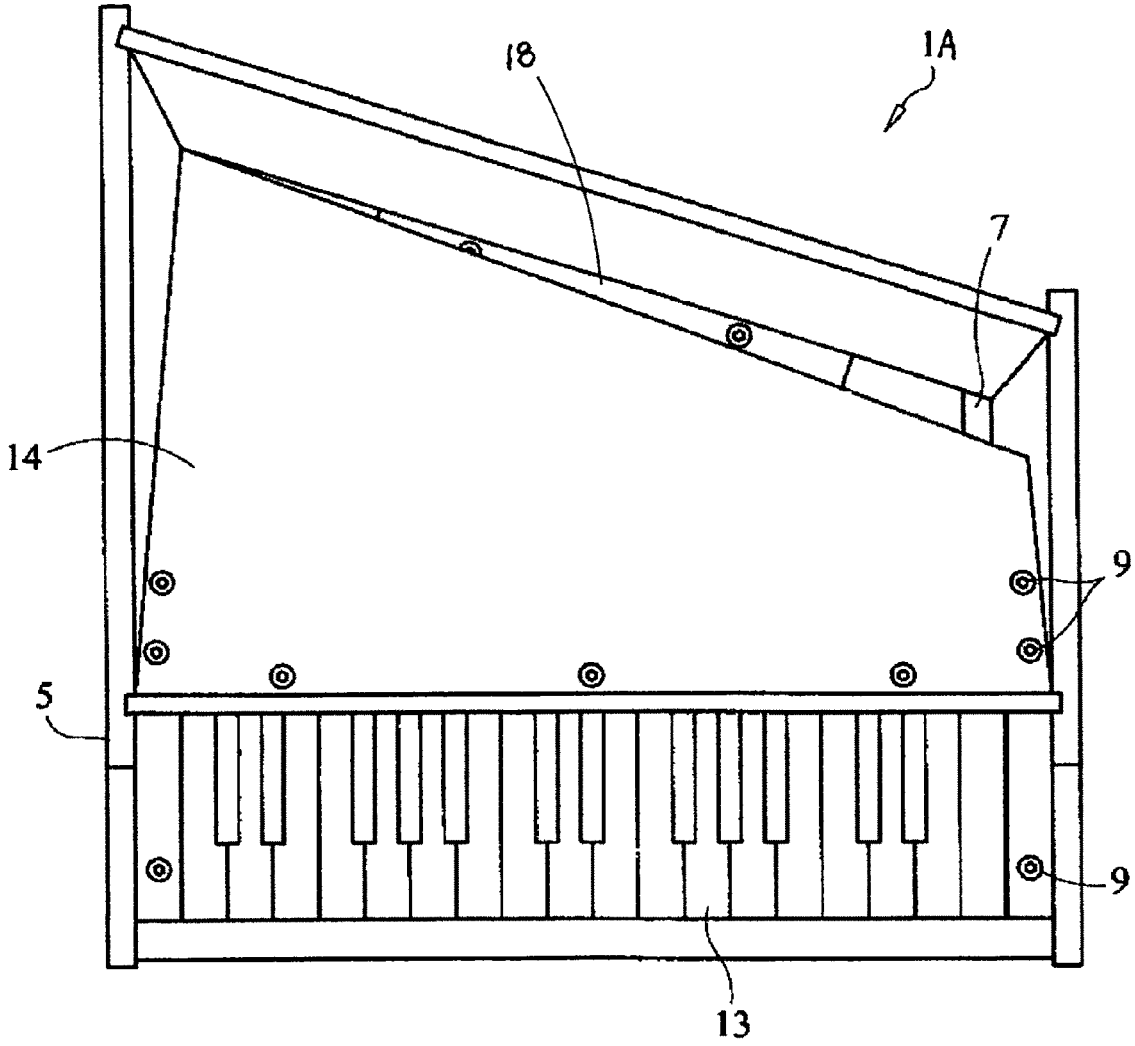
FIG. 2 provides a top view of the baby grand toy piano of FIG. 1 showing the protective plate.

This is a specification for, and a process for manufacturing, a toy piano. Toy pianos can be manufactured to look and function like a grand (or baby grand) piano 1A or an upright piano 1B. Regardless of the manufacturer, this process will be applicable to either kind of toy piano A toy piano is, in many respects, a miniature version of a real piano. Toy pianos 1A, 1B have a very distinctive sound when played which differentiates them from the sound of a standard piano. Like a standard piano a toy piano 1A, 1B has a set of keys that are played by a person. Toy pianos 1A, 1B are typically played by children and are usually given as a first piano or as a learner piano. The toy pianos also have a limited number of keys, as opposed to the 88 keys that are found on most standard upright or grand pianos. The person plays a piano in the same manner although typically the sound on a toy piano 1A, 1B is different than a standard upright or baby grand piano The piano 1A, 1B is typically supported by legs 2 attached to the bottom member 7 of the piano by a threaded member (although there are a variety of ways to attach a piano leg and no specific claim is being made to the type of attachment of the piano leg). The bottom surface of the bottom member 7 of the piano is typically planar and can advantageously form one of the surfaces on which the interior components of the piano will rest and be housed in the baby grand piano 1A. (See, e.g., FIGS. 1 through 3). Joined to this planar surface will be two lateral side members 5. Front side member(s) 3, 3A and back side member(s) 4 are joined to these lateral side members 5, 5A. Finally, a top member 8 will, when joined together with the aforesaid side members form an enclosure and cavity that will house interior parts of the piano. When the piano is assembled the interior components of the piano will be protected by this casing.

Additionally, the keys 13 of the piano will usually be placed on the planar bottom member(s) 7, 7A and positioned exterior to the cavity; the front side members 3, 3A will be positioned so that the interior components of the piano cannot be damaged. The lateral side members 5, 5A and the back member 4 will be attached to each other at or near their respective ends. The end 10 of the back member will be manufactured so that this portion will fit into a second groove 22 on the surface of the side members 5, 5A. A first groove 23 will allow the side members 5, 5A to be attached to respective front members 3, 3A.

Figure 3:
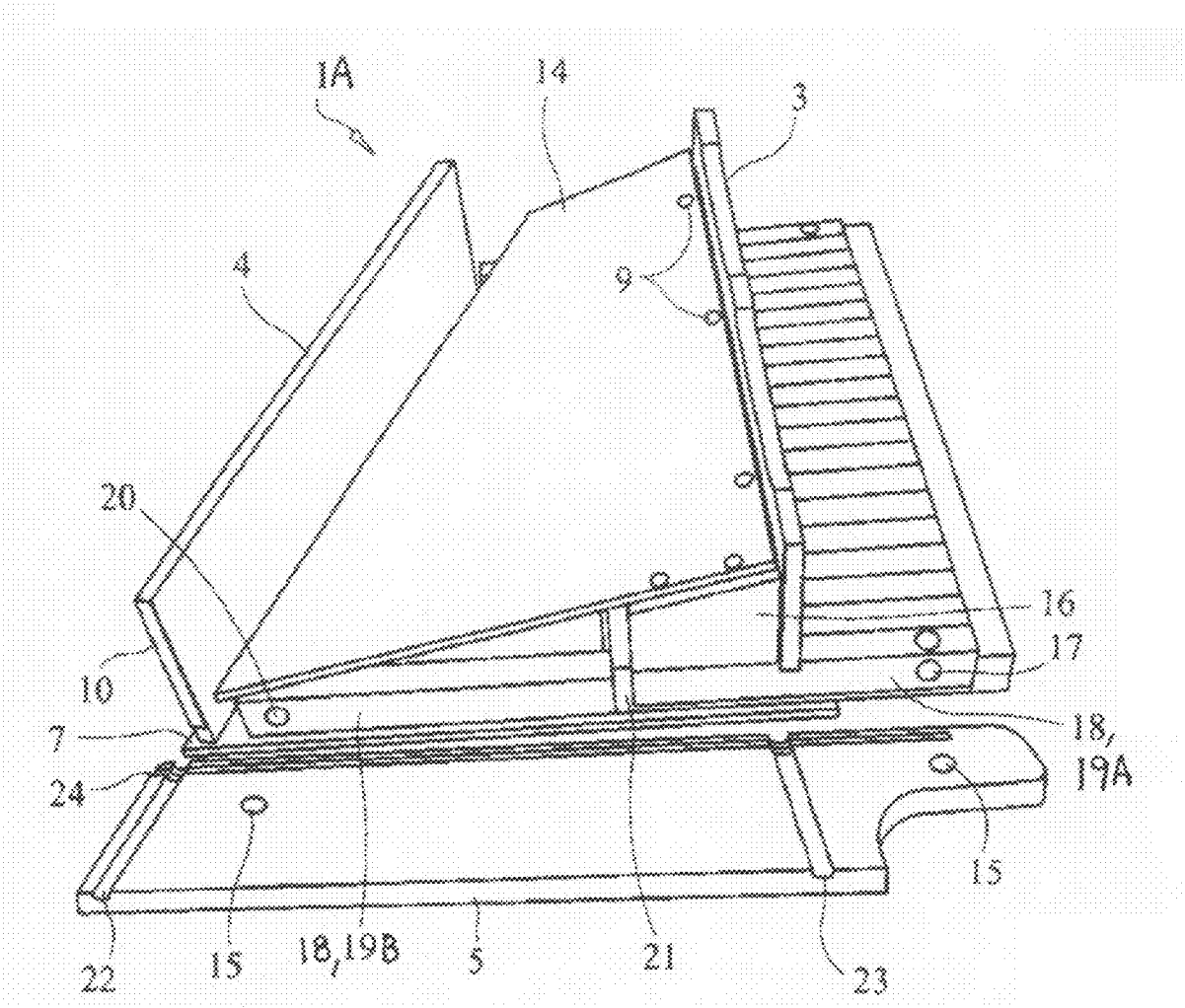
FIG. 3 provides a partially disassembled side perspective view of the baby grand piano of FIG. 1.
Figure 4:
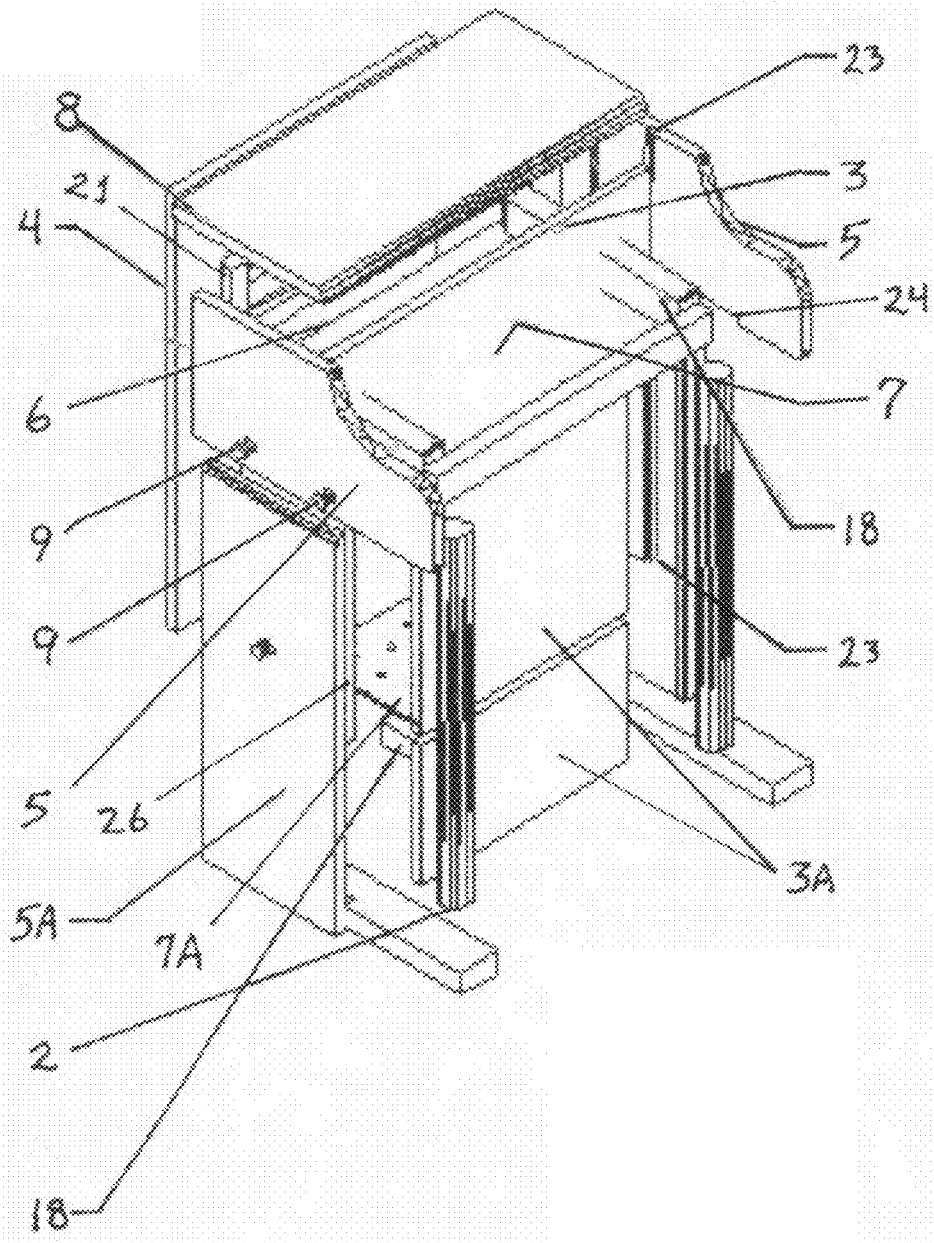
FIG. 4 provides a partially exploded view of an upright toy piano in accordance with the teachings of my invention.
Figure 5:
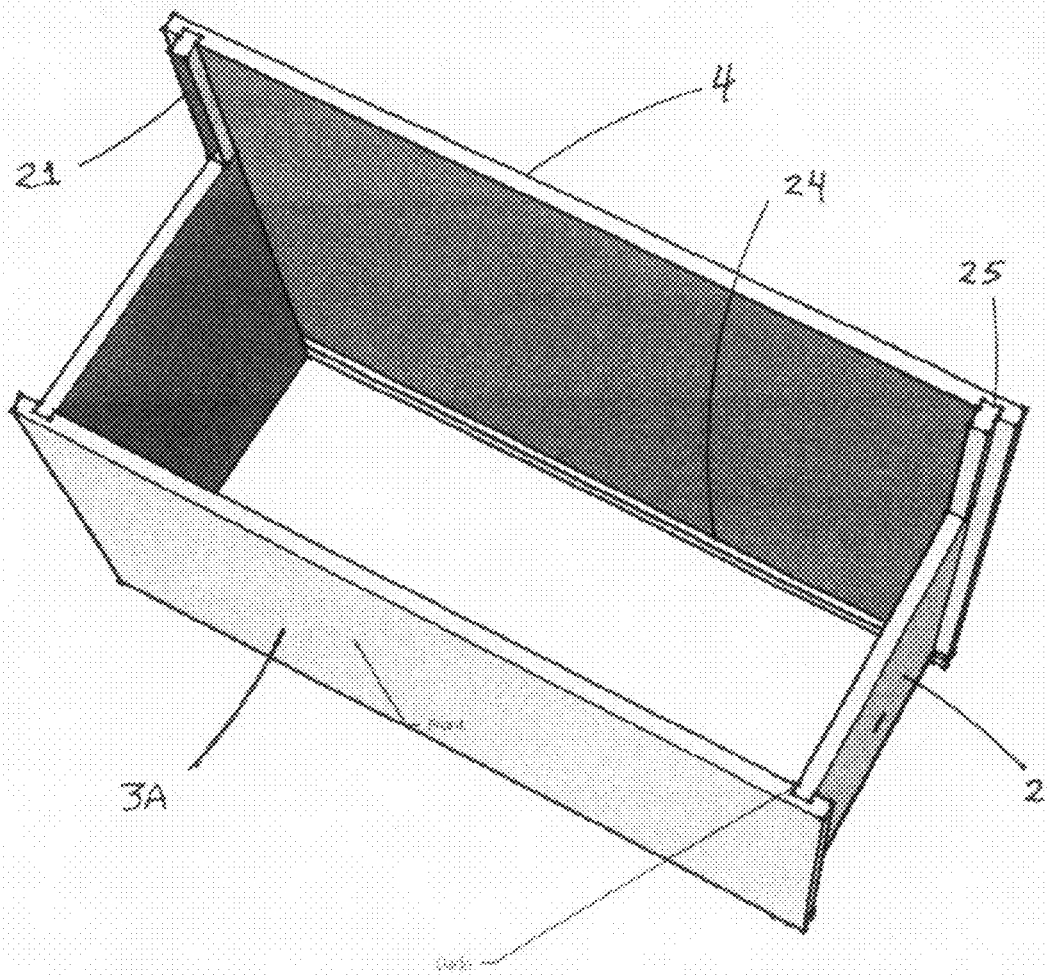
FIG. 5 provides a perspective view of portion of the upright toy piano illustrating the manner in which portions of stop piece/block members are inserted into dados provided in side forming members.

Stop pieces 18, 19A, 19B, 21, and 26 attached in appropriate locations on side forming members provide part of the means by which the parts of the piano of my invention are non-permanently joined together, as well as providing stability and durability to its design. Their function, durability and stability are enhanced by nesting some portion of the blocks (or planar pieces) forming the stop pieces in a parallel groove ("dado") provided in the surface of the said side forming member(s) to which they are permanently affixed. In the embodiment illustrated in FIGS. 1 through 3, a first horizontal stop 19A on the top surface of the planar bottom member 7 will extend from the keys 13 to a vertical stop 21. A second horizontal stop 19B is placed against the vertical stop 21 and extends the length of the piano a predetermined distance. In the case of the baby grand piano 1A illustrated in these figures, the length of the second horizontal stop 19B on the other side of the piano as depicted in FIG. 3 will be somewhat shorter because of the shape of the baby grand piano. In the preferred embodiment of the upright toy piano 1B illustrated in FIGS. 4 and 5, a further variation is illustrated—a planar stop piece 26 extending between and joining back member 5 and lower front member 3A.

Others aspects of my invention also serve to facilitate its purposes, construction, and the replacement features of its design. Holes 15 in the side members 5, 5A permit a connector 9 to be inserted into the side members 5, 5A as well as the stop pieces provided therefor. On the bottom of the side members 5, slits 24 may be provided that allow the side member 5 to be inserted over the planar bottom member 7. The connector 9 for the side members 5, 5A is advantageously a threaded member, which can be installed using a standard screwdriver, a slotted Phillips head or possibly an Allen wrench.

Inside the enclosure/compartment formed by the side members 5, 5A, the back member 4, bottom members 7, 7A, and the front members 3, 3A will be placed the sound board 6. The sound board 6 will be a board with a series of rods that will reproduce the sound of the piano when the rods are struck by components of the piano. The sound board is struck by a series of hammers that are connected to the keys 13 of the piano. Levers (not depicted) are attached to the keys 13 of the piano and are attached to hammers (not depicted) that strike the rods of the sound board.

It is imperative that the sound board be protected as much as possible. Thus, a protective plate 14 may be placed between the sound board and the top member 8 of the piano. Further, in both embodiments illustrated, the top member 8 of the piano will protect the interior component once it is placed on the piano. This is true regardless of whether or not the piano is a baby grand 1A or an upright toy piano 1B. In the Baby Grand Toy Piano!A Another stop piece housing 16 will be placed on top of a portion of the first horizontal member 18 and be placed between one surface of the vertical stop 21 and one surface of the front member 3. The protective plate 14 is secured to the stop piece 16 with a connector.

The aforesaid configuration allows for easy replacement of damaged parts. Thus, by way of example, in the event of a side member 5 being damaged, the connector 9 is loosened and the side member 5 is allowed to be removed. An identical side member 5 can then be reinstalled simply by positioning the slots on the bottom edge of the side member 5 and reinstalling the connector. The first and second groove 23, 22 insure appropriate alignment of the side member 5. However, numerous variations are possible without deviating from and/or exceeding the spirit and scope of my invention. Thus, as the foregoing should also make clear, numerous variations can be made without exceeding the inventive concept. Moreover, several of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the claims that follow.

Finally, the following parts list for the drawing figures may be found to be of assistance in understanding more fully the concepts of my invention:

1A—Baby Grand Toy Piano
1B—Upright Toy Piano
2—Legs/Support Members (Grand/Upright)
3—Front Member (Grand/Upright)
3A—Lower Front Member (Upright)
4—Back Member (Grand/Upright)
5—Side Members (Grand/Upright)
5A—Lower Side Member (Upright)
6—Sound Board (Grand/Upright)
7—Bottom Member (Grand/Upright)
7A—Lower Bottom Member (Upright)
8—Top Member (Grand/Upright)
9—Connectors (Grand/Upright)
10—Side of back member (Grand/Upright)
13—Keys (Grand/Upright)
14—Protective Plate (Grand)
15—Hole in Side Member (Grand/Upright)
16—Stop Piece Housing (Grand)
17—Hole for Connector (Grand/Upright)
18—Horizontal Stop Piece (Grand/Upright)
19A—First Horizontal Stop Piece (Grand)
19B—Second Horizontal Stop Piece (Grand)
20—Hole for Connector (Grand/Upright)
21—Vertical Stop Piece (Grand/Upright)
22—Second Groove (Grand/Upright)
23—First Groove (Grand/Upright)
24—Slits (Grand/Upright)
25—Dado (Grand/Upright)
26—Planar Stop Piece (Upright)

What is claimed is:

1. A toy piano, comprising:

a predetermined piano shape created by non-permanently joining a plurality of side forming members including a bottom member and a plurality of side members to form an enclosure, which side members include a back side member, a front side member, and lateral side members;

a sound board reproducing the sound of a toy piano, said sound board being secured within said enclosure; and wherein at least one of a block member is affixed to a said side forming member, allowing an other said side forming member to be non-permanently affixed thereto via connectors anchored to said block member, a horizontal slit is provided near the bottom of a said side member to fit over an edge of the bottom member, allowing the edge of said bottom member to non-permanently nest therein, and a vertical groove is provided near an end of a said side member to fit over an end of an other said side member, allowing the end of said other side member to non-permanently nest therein.

2. The toy piano of claim 1, wherein at least one of:

a horizontal block member is affixed to the bottom member, with a said side member non-permanently affixed to said block member, said block member is affixed to said side forming member in part by inserting a portion of said block member into a dado provided in the surface of said side forming member, holes on said side member are provided at predetermined locations, which side member holes correspond with holes in said block member at predetermined locations such that a non-permanent connector can be inserted into said holes to non-permanently affix said side member to said block member, a protective plate is placed over said sound board, with a non-permanent connector securing the protective plate, said block member is adjacent to a said lateral side member, and said block member is a horizontal block member adjacent and parallel to a lateral side member and is comprised of a first horizontal member and a second horizontal member, and a vertical stop is placed between said first horizontal member and second horizontal member.

3. The toy piano of claim 2, wherein a stop piece housing is placed between the vertical stop and the front member.

4. The toy piano of claim 3, wherein at least one of: the protective plate is secured to the stop piece housing, and the stop piece housing extends from one edge of the piano to the other.

5. A toy piano, comprising:

a predetermined piano shape created by non-permanently joining a plurality of side forming members including a bottom member and a plurality of side members to form an enclosure, which side members include a back side member, a front side member, and lateral side members;

a sound board reproducing the sound of a toy piano, said sound board being secured within said enclosure;

wherein block members are affixed to a portion of said side forming members, allowing other side forming members to be non-permanently affixed thereto via connectors anchored to said block members;

wherein horizontal slits are provided near the bottom of a portion of said side members to fit over edges of the bottom member, allowing the edges of said bottom member to non-permanently nest therein;

wherein vertical grooves are provided near ends of a portion of said side members to fit over ends of other side members, allowing the ends of said other side members to non-permanently nest therein; and wherein said block members are affixed to side forming members in part by inserting portions of said block members into dados provided in the surface of said side forming members.

6. The toy piano of claim 5, wherein at least one of:

horizontal block members are affixed to the bottom member, with a portion of said side members non-permanently affixed to said block members, holes on a portion of said side members are provided at predetermined locations, which side member holes correspond with holes in said block members at predetermined locations such that a non-permanent connector can be inserted into said holes to non-permanently affix said side members to said block members, a protective plate is placed over said sound board, with a non-permanent connector securing the protective plate, said block members are adjacent to the lateral side members, and said block members are horizontal block members which are adjacent and parallel to the lateral side members and each is comprised of a first horizontal member and a second horizontal member, and a vertical stop is placed between said first horizontal member and second horizontal member.

7. The toy piano of claim 6, wherein a stop piece housing is placed between the vertical stop and the front member.

8. The toy piano of claim 7, wherein at least one of: the protective plate is secured to the stop piece housing, and the stop piece housing extends from one edge of the piano to the other.

9. A toy piano, comprising:

a predetermined piano shape created by non-permanently joining a plurality of side forming members including a bottom member and a plurality of side members to form an enclosure, which side members include a back side member, a front side member, and lateral side members;

a sound board reproducing the sound of a toy piano, said sound board being secured within said enclosure;

wherein block members are affixed to a portion of said side forming members, allowing other side forming members to be non-permanently affixed thereto via connectors anchored to said block members;

wherein horizontal slits are provided near the bottom of a portion of said side members to fit over edges of the bottom member, allowing the edges of said bottom member to non-permanently nest therein;

wherein vertical grooves are provided near ends of a portion of said side members to fit over ends of other side members, allowing the ends of said other side members to non-permanently nest therein;

wherein said block members are affixed to side forming members in part by inserting portions of said block members into dados provided in the surface of said side forming members; and wherein holes on a portion of said side members are provided at predetermined locations, which side member holes correspond with holes in said block members at predetermined locations such that a non-permanent connector can be inserted into said holes to non-permanently affix said side members to said block members.

10. The toy piano of claim 9, wherein at least one of:

horizontal block members are affixed to the bottom member, with a portion of said side members non-permanently affixed to said block members, a protective plate is placed over said sound board, with a non-permanent connector securing the protective plate, said block members are adjacent to the lateral side members, and said block members are horizontal block members which are adjacent and parallel to the lateral side members and each is comprised of a first horizontal member and a second horizontal member, and a vertical stop is placed between said first horizontal member and second horizontal member.

11. The toy piano of claim 10, wherein a stop piece housing is placed between the vertical stop and the front member.

12. The toy piano of claim 11, wherein at least one of: the protective plate is secured to the stop piece housing, and the stop piece housing extends from one edge of the piano to the other.

13. The toy piano of claim 1, wherein when two vertical grooves are provided in each lateral side member allowing front and back side pieces to nest therein, and block member/non-permanent connector combinations are used to non-permanently attach the lateral side members to at least one of the bottom member and the top member, holding the front and back side members locked into position in the aforesaid vertical grooves with the horizontal slits further stabilizing the connection and positioning of the lateral side members with respect to the bottom member.

14. The toy piano of claim 2, wherein when two vertical grooves are provided in each lateral side member allowing front and back side pieces to nest therein, and block member/non-permanent connector combinations are used to non-permanently attach the lateral side members to at least one of the bottom member and the top member, holding the front and back side members locked into position in the aforesaid vertical grooves with the horizontal slits further stabilizing the connection and positioning of the lateral side members with respect to the bottom member.

15. The toy piano of claim 5, wherein when two vertical grooves are provided in each lateral side member allowing front and back side pieces to nest therein, and block member/non-permanent connector combinations are used to non-permanently attach the lateral side members to at least one of the bottom member and the top member, holding the front and back side members locked into position in the aforesaid vertical grooves with the horizontal slits further stabilizing the connection and positioning of the lateral side members with respect to the bottom member.

16. The toy piano of claim 6, wherein when two vertical grooves are provided in each lateral side member allowing front and back side pieces to nest therein, and block member/non-permanent connector combinations are used to non-permanently attach the lateral side members to at least one of the bottom member and the top member, holding the front and back side members locked into position in the aforesaid vertical grooves with the horizontal slits further stabilizing the connection and positioning of the lateral side members with respect to the bottom member.

17. The toy piano of claim 9, wherein when two vertical grooves are provided in each lateral side member allowing front and back side pieces to nest therein, and block member/non-permanent connector combinations are used to non-permanently attach the lateral side members to at least one of the bottom member and the top member, holding the front and back side members locked into position in the aforesaid vertical grooves with the horizontal slits further stabilizing the connection and positioning of the lateral side members with respect to the bottom member.

18. The toy piano of claim 10, wherein when two vertical grooves are provided in each lateral side member allowing front and back side pieces to nest therein, and block member/non-permanent connector combinations are used to non-permanently attach the lateral side members to at least one of the bottom member and the top member, holding the front and back side members locked into position in the aforesaid vertical grooves with the horizontal slits further stabilizing the connection and positioning of the lateral side members with respect to the bottom member.

* * * * *